US005818324A

United States Patent [19]

Richels

[11] Patent Number: 5,818,324

[45] Date of Patent: Oct. 6, 1998

[54] WIRE COIL POTENTIOMETER WIPER

[75] Inventor: Gerald D. Richels, Blaine, Minn.

[73] Assignee: Resistance Technology, Inc., Arden Hills, Minn.

[21] Appl. No.: 747,757

[22] Filed: Nov. 13, 1996

[51] Int. Cl.[6] ..... H01C 10/32

[52] U.S. Cl. ..... 338/162; 338/157; 338/202; 338/160; 338/167

[58] Field of Search ..... 338/96, 154, 155, 338/157, 160, 162, 167, 168, 169, 170, 176, 190, 194, 202

[56] References Cited

U.S. PATENT DOCUMENTS

| | | | |
|---|---|---|---|
| 3,076,162 | 1/1963 | Ferrari | 338/167 |
| 3,259,727 | 7/1966 | Casler | 200/570 |
| 3,431,530 | 3/1969 | Bang | 338/183 |
| 3,453,584 | 7/1969 | Hanson | 338/183 |
| 3,531,753 | 9/1970 | Geese | 338/157 |
| 3,531,754 | 9/1970 | Krupsfy | 338/157 |
| 3,699,492 | 10/1972 | Yoshihara | 338/69 |
| 3,964,011 | 6/1976 | Ragan | 338/166 |
| 4,020,444 | 4/1977 | Oelsch et al. | 338/202 |
| 4,121,188 | 10/1978 | Ragan | 338/174 |
| 4,158,831 | 6/1979 | Ragan | 338/174 |
| 4,225,845 | 9/1980 | Ragan | 338/174 |
| 4,246,565 | 1/1981 | Wiley et al. | 338/163 |
| 4,361,824 | 11/1982 | Eck | 338/171 |
| 4,528,545 | 7/1985 | Lang | 338/184 |
| 4,839,627 | 6/1989 | Okazaki et al. | 338/174 |
| 5,675,309 | 10/1997 | DeVolpi | 338/68 |

FOREIGN PATENT DOCUMENTS

| | | | |
|---|---|---|---|
| 134748 | 10/1902 | Germany | 338/202 |
| 1415842 | 11/1975 | United Kingdom | 338/167 |

OTHER PUBLICATIONS

Remane (German 134748) translation.

*Primary Examiner*—Renee S. Luebke
*Assistant Examiner*—Karl Easthom
*Attorney, Agent, or Firm*—Kinney & Lange, P.A.

[57] ABSTRACT

A miniature potentiometer having a housing with a plurality of resistor elements and a coil spring wiper having canted coils affixed to a knob that is rotatably disposed within the housing. The canted coil spring wipers are in conductive contact with the resistor elements of the housing.

5 Claims, 2 Drawing Sheets

WIRE COIL POTENTIOMETER WIPER

BACKGROUND OF THE INVENTION

The present invention relates generally to a spring wiper for use in a potentiometer. More particularly, the present invention relates to an spring wiper having canted coils for use in a hearing aid potentiometer. Efforts have been made to reduce the size of hearing aids and thereby make the hearing aid less noticeable when worn in or around a person's ear. A limit on the lower threshold of hearing aid size is that the controls on the hearing aid must be sufficiently large to allow a person wearing the hearing aid to readily adjust the operation of the hearing aid, such as changing the volume using a potentiometer. It has been found that designing hearing aids with potentiometer having a diameter as small as ¼ of an inch allows the hearing aid to be formed with a desirable size while allowing the operation of the hearing aid to be readily controlled by most users.

As the size of hearing aids becomes increasingly smaller, the components used in manufacturing the hearing aids must also be made in progressively smaller sizes. In addition to allowing the hearing aid to be easily operated, the hearing aid components must provide the hearing aid with sufficient integrity so that the hearing aid operates reliably over a desired lifespan. One area of the hearing aid that is particularly susceptible to degradation over extended periods of use is the potentiometer.

Hearing aid potentiometers typically contain resistor elements that are mounted inside a housing. Potentiometers also include a control knob that is rotatably attached to the housing. A wiper is attached to the knob adjacent to the resistor elements. Rotation of the control knob with respect to the housing causes the wiper to move with respect to the resistor elements and thereby allows characteristics, such as volume, of the hearing aid to be adjusted.

Wipers used in conjunction with prior art hearing aid potentiometers are typically either single ball wipers, double ball wipers, or brush wipers. Single and double ball wipers are formed by bending a resilient metallic piece so that a plurality of arms extend from the resilient metallic piece.

When single and double ball wipers are incorporated into a potentiometer, the arms are compressed to provide electrical contact between the wiper and the resistor elements that are placed adjacent to the wiper in the potentiometer. While compression of the arms is essential to obtain electrical contact, continuous compression of the arms eventually causes the arms to relax. Over time, relaxation of the arms reduces the quality of the electrical contact between the wiper and the resistor elements and thereby impairs the operation of the potentiometer. When this occurs, the wiper must be replaced. Replacing the wiper in the potentiometer is a difficult operation because of the relatively small size of the potentiometer. As a result, the entire potentiometer is typically replaced.

Brush wipers commonly have approximately 10 resilient metal contacts that are generally U shaped. The resilient metal contacts are mounted on a base. Mounting the resilient metal contacts on a base having a width of approximately 0.030 inches and a length of approximately 0.040 inches involves intricate and costly processes. The expense of manufacturing the brush wipers has precluded the wide spread commercial use of brush wipers in hearing aid potentiometers.

Using a spring as a wiper in a relatively large potentiometer is described in several U.S. patents. For example, Bang U.S. Pat. No. 3,431,530 and Hanson U.S. Pat. No. 3,453,584, each describe structures in which a spring is used as a wiper in a potentiometer.

Ragan U.S. Pat. No. 3,964,011 (hereinafter Ragan '011) describes the use of a coil spring wiper in a circular potentiometer design. Ragan '011 discloses positioning a rectangular resilient pad adjacent to the spring wiper opposite the conductive elements. Ragan '011 indicates that the described potentiometer structure allows the size of the potentiometer to be reduced when compared to the prior art potentiometer.

Ragan U.S. Pat. No. 4,121,188, 4,158,831, and 4,225,845 (hereinafter Ragan '188, '831, and '845, respectively) also describe the use of a coil spring wiper in a circular potentiometer. Ragan '188, '831, and '845 disclose positioning a cylindrical resilient pad adjacent to the spring wiper opposite the conductive elements and thereby describe the advantages over the structure disclosed in Ragan '011.

Eck U.S. Pat. No. 4,361,824 discloses a circular potentiometer having an arm that is centrally mounted in the potentiometer. A wiper spring is attached to a distal end of the arm so that the spring wiper contacts conductive elements in the potentiometer.

Oelsch et al. U.S. Pat. No. 4,020,444 describes a slider arm for a potentiometer. The slider arm includes a spring leaf with a coil spring wiper attached to a distal end of the spring leaf. Attachment of the spring wiper to the spring leaf arm allows the spring wiper to conductively contact conductive elements in the potentiometer.

SUMMARY OF THE INVENTION

The present invention includes a miniature potentiometer having a housing, a knob, a plurality of resistor elements, and a canted coil spring wiper. The resistor elements are fixedly attached to the housing.

The canted coil spring wiper is attached to the knob so that when the knob is rotatably mounted to the housing, the canted coil spring wiper contacts the resistor elements and end silver. Mounting the knob to the housing deflects the canted coil spring wiper and thereby providing a force that ensures good conductive contact of every coil between the wiper and the resistor elements and end silver.

DETAILED DESCRIPTION OF THE PREFERRED EMBODIMENTS

Figure 1:
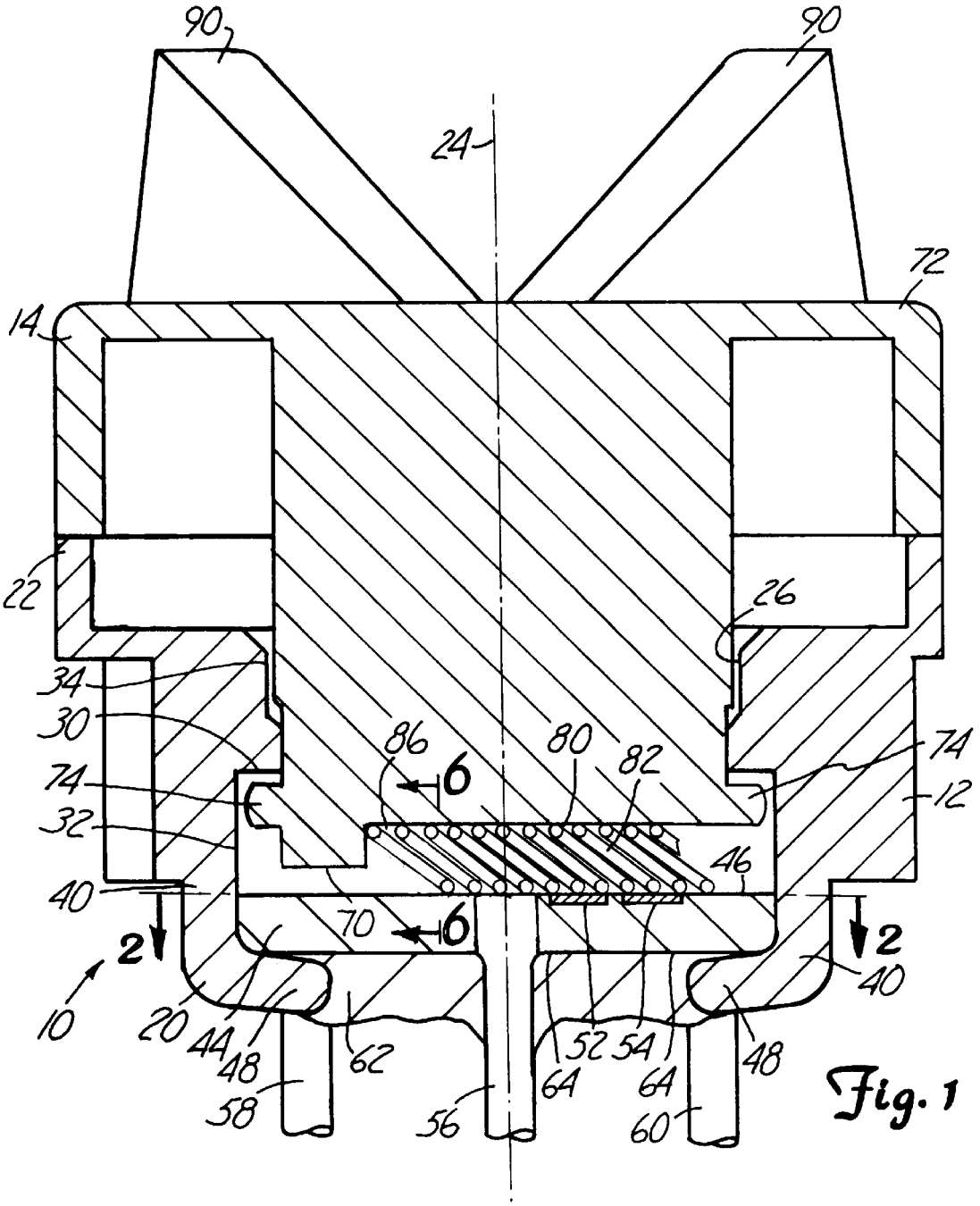
FIG. 1 is a sectional view of a potentiometer according to the present invention.

The present invention is a miniature potentiometer, as most clearly illustrated at 10 in FIG. 1. The potentiometer includes a housing 12 and a knob 14. The knob 14 is rotatably attached to the housing 12.

The housing 12 has a first end 20 and a second end 22, which is opposite the first end 20. The housing 12 preferably has a substantially circular profile with a central axis 24.

The housing 12 includes a central bore 26, which is oriented along the central axis 24, that extends from the first end 20 to the second end 22. The central bore 26 is generally divided into two sections by an annular shoulder 30. A first section 32 extends from the shoulder 30 towards the first end 20. A second section 34 extends from the shoulder 30 towards the second end 22. The first section 32 preferably has a diameter that is greater than a diameter of the second section 34.

Proximate to the first end 20, the housing 12 includes an annular skirt portion 40 that extends from the housing 12. The skirt 40 has an end section 48 that extends towards the central axis 24 to retain a substrate 44 in the first section 20.

The substrate board 44 includes a plurality of resistor elements 54 mounted into a top surface 46 of the substrate board 44. The resistor elements 54 are preferably arranged in a semi-circular pattern on the top surface 46 of the substrate board 44, as most clearly illustrated in FIG. 2. Arrangement of the resistor elements 54 and end silver 52 on the substrate board 44 allows the resistor elements 54 and end silver 52 to be alternatively contacted by a wiper.

Figure 2:
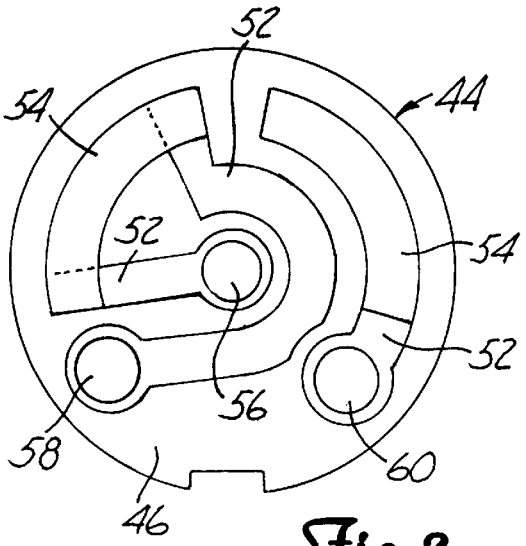
FIG. 2 is a top view of a substrate board, which is taken along a line 2—2 in FIG. 1.

Lead wires 56, 58, 60 extend from the end silver 52, as most clearly illustrated in FIGS. 1 and 2. The lead wires 56, 58, 60 operably connect the potentiometer 10 to other portions of the hearing aid.

An UV glue sealer 62 is used to close off the end portion 48 of the skirt 40. The UV glue sealer 62 also helps retain the substrate 44 in a fixed position within the housing 12.

The knob 14 has a first end 70 and a second end 72, which is opposite first end 70. The knob 14 is rotatably attached to the housing 12 so that the first end 70 is within the central bore 26. A portion of the knob 14 proximate to the first end 70 that extends into the central bore 26 has a diameter that is approximately the same as the diameter of the second section 22. This configuration allows the knob 14 to rotate with respect to the housing 12 while minimizing wobbling.

The knob 14 also includes an outwardly directed annular lip 74 that is wider than the first section 20. The outwardly directed lip 74 thereby retains the knob 14 in a rotatable relation with respect to the housing 12.

Proximate to the first end 70, the knob 14 includes a recess 80 that is adapted to receive a canted coil spring wiper 82. The recess 80 has a first side wall 110, a second side wall 112 and a base wall (or floor) 114, as most clearly illustrated in FIG. 3. The base wall 114 extends between the first side wall 110 and the second side wall 112. Preferably, the first side wall 110 is selected with a length that is greater than the second side wall 112 so that the base wall 114 is inclined at an angle β of approximately 10 degrees. Surprisingly, orienting the base wall 114 at the angle β improves the performance of the canted coil spring 82 in maintaining substantially even contact with the resistor element 54, the end silver 52, and the lead wire 56.

The recess 80 preferably has a width 116 of between approximately 0.012 and 0.013 inches. The second side wall 112 preferably has a length 118 of between about 0.011 and 0.012 inches.

The knob 14 preferably includes a plurality of wings 90 that extend from the second end 72 of the knob 14, as most clearly illustrated in FIG. 1. The wings 90 enhance a person's ability to grasp the knob 14 when rotating the knob 14 with respect to the housing 12.

The canted coil spring wiper 82 is preferably formed from a beryllium copper alloy wire with gold or silver plating. The wire preferably has a diameter 126 of approximately 0.002 inches, as most clearly illustrated in FIG. 4. The canted coil spring wiper 82 preferably has a length 120 of approximately 0.045 inches, a height 122 of approximately 0.015 inches, and a width of approximately 0.018 inches.

Figure 3:
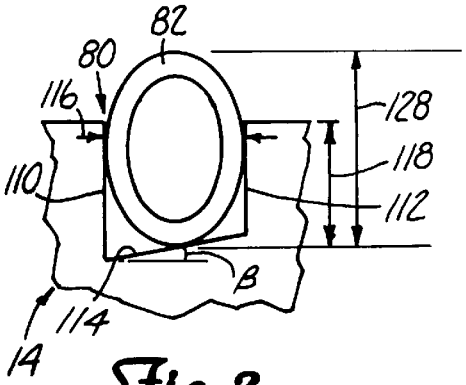
FIG. 3 is a sectional view of a canted coil spring wiper in a recess on a knob of the potentiometer.
Figure 6:
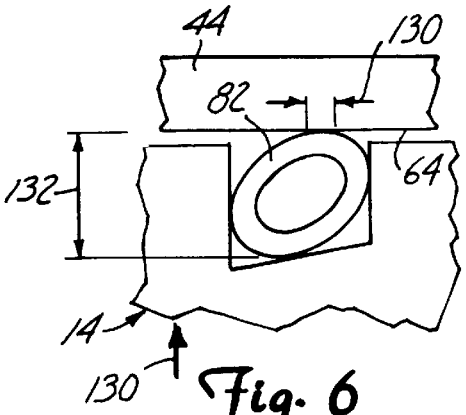
FIG. 6 is a sectional view of the canted coil spring wiper in a compressed assembled working condition, which is taken along a line 6—6 in FIG. 1.

The wire is coiled about an axis 92 and preferably includes between approximately 9 and 11 coils 94. The elliptical nature of the coil wire permits the wire to deflect from an initial position as illustrated in FIG. 3 to a deflected position as illustrated in FIG. 6 thereby permitting conformance of the wiper 82 against the resistor element 54, the end silver 52, and lead wire 56. These traits result in superior conductive contact between the wiper 82 and the resistor element 54, end silver 52, lead wire 56 of the substrate board 44. The deflection of the coils 94 of the wiper 82 provides a resilient force that ensures good contact between the wiper 82 and the resistor element 54, end silver 52, lead wire 56.

The recess 80 along with the incline of the base wall 114 aids in deflecting the wiper coil of the present invention such that when viewed cross sectionally, as in FIGS. 3 and 6, it appears that the wiper coil has rotated its position within the recess 80. However, the wiper coil does not rotate about its axis within the recess. Due to the elliptical nature of the coil, the coil appears to have rotated about its axis, but instead, the coil deflects in an inclined fashion and gives the appearance of rotation.

The coils 94 are preferably canted. As used herein, the term canted means that the coils 94 are inclined from a plane that is normal to the axis 92 of the canted coil spring wiper 82. More particularly, each coil 94 has a front portion 100 and a back portion 102 that are oriented at angles γ and δ, respectively, that are each less than 90 degrees.

Figure 5:
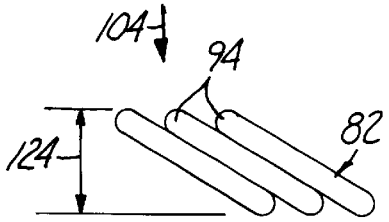
FIG. 5 is a side view of the canted coil spring wiper with the coils deflected to a maximum position or working position.
Figure 4:
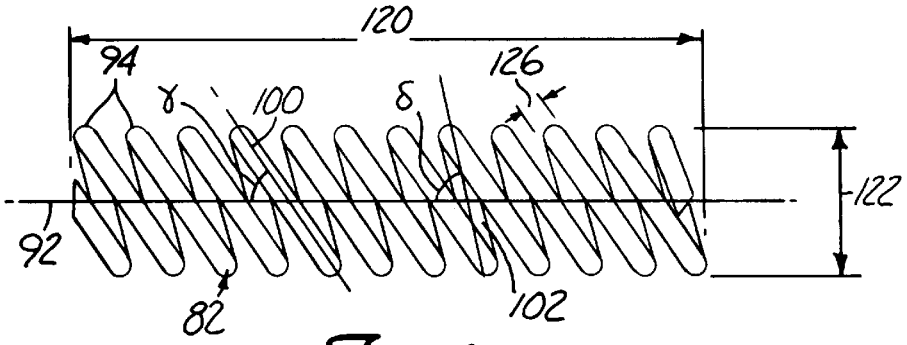
FIG. 4 is a side view of the canted coil spring wiper with coils of the elliptical spring in initial cant position.

When the canted coil spring wiper 82 is not subjected to any forces, the coils 94 are in an initial cant position, as most clearly illustrated in FIG. 4. The canted coil spring wiper 82 deflects in response to application of a force in a direction that is substantially normal to the axis 92, as indicated by arrow 104 in FIG. 5. Deflection of the canted coil spring wiper 82 increases the cant of the coils 94.

The coils 94 attain a maximum cant position when the canted coil spring wiper 82 is deflected so that adjacent coils 94 are substantially in contact with each other. When the coils 94 are oriented at a cant that is between the initial cant position and the maximum cant position, the coils 94 are referred to as being at an intermediate cant position.

A height 124 of the canted coil spring wiper 82 when the coils 94 are in the maximum cant position is approximately 37.1 percent less than the height 122 of the canted coil spring wiper 82 when the coils 94 are in the initial cant position.

When the canted coil spring wiper 82 is initially placed in the recess 80, the elliptical spring wiper 82 deflects and causes the cant of the coils 94 to increase. In this configuration, the canted coil spring wiper 82 extends between the first and second side walls 110, 112 and has a height 128 of approximately 0.018 inches, and as most clearly illustrated in FIG. 3.

As the knob 14 is moved into attachment to the housing 12, as indicated by arrow 130, the canted coil spring wiper 82 further deflects and thereby increases the cant of the coils 94, as most clearly illustrated in FIG. 6. Deflection decreases the height of the canted coil spring wiper 82 by approximately 30 percent when compared to the height of the canted coil spring wiper 82 when the coils 94 are in the initial cant position.

When the knob 14 is rotatably attached to the housing 12, the canted coil spring wiper 82 is deflected to a height 132 of between approximately 0.013 and 0.014 inches. Deflecting the canted spring wiper 82 to this height leaves a separation between the lower surface 46 of the substrate board 44 and first end 70 of the knob 14 of approximately 0.002 inches. Maintaining the substrate board 44 in a spaced-apart relationship with respect to the knob 14 minimizes degradation of the components in the potentiometer 10 resulting from frictional contact between the components.

When the canted coil spring wiper 82 is in the compressed configuration, each coil 92 of the canted coil spring wiper 82 contacts the element 44 over a length 130 of approximately 0.002 inches, as most clearly illustrated in FIG. 6. Contact between the canted coil spring wiper 82 and the substrate board 44 of the length 130 provides a desirable level of conductivity during the operation of the potentiometer 10 of the present invention.

Using the canted coil spring wiper 82 provides surprising results when used with the potentiometer of the present invention compared to potentiometers constructed with other types of wipers including conventional circular spring wipers. In particular, the canted coil spring wiper 82 maintains a desirable conductivity level over a wider range of area than prior art potentiometers formed with the single ball and double ball wipers. As such, constructing the potentiometer with the canted coil spring wiper 82 increases the functional by usable area of the potentiometer.

Although the present invention has been described with reference to preferred embodiments, workers skilled in the art will recognize that changes may be made in form and detail without departing from the spirit and scope of the invention.

What is claimed is:

1. A hearing aid potentiometer comprising:

a housing having a resistor element on a plane attached thereto;

a knob rotatably attached to the housing and rotatable in a direction parallel to the plane, wherein the knob includes a recess having sidewalls and an inclined floor connected to the sidewalls, the floor being oriented at an incline from the side walls in the recess; and a non-torroidal spring wiper in the recess and having elliptical coils abutting the inclined floor and the sidewalls, wherein the coils of the spring wiper are oriented about an axis, wherein the coils are canted so that the coils are offset from a plane that is normal to the axis, wherein the coils are initially oriented in an initial cant position, wherein the spring wiper is retained in the recess adjacent the resistor element, and wherein attachment of the knob to the housing when assembling the hearing aid potentiometer deflects the spring wiper to a final canted position where the coils are in conductive contact with the resistor elements.

2. The hearing aid potentiometer of claim 1, wherein a height of the canted coil spring wiper in the final canted position is approximately 30 percent less than a height of the spring wiper when the coils are in the initial cant position.

3. The hearing aid potentiometer of claim 1, wherein the coils of the canted spring wiper are oriented about an axis and wherein the coils are offset from a plane that is normal to the axis.

4. The hearing aid potentiometer of claim 3, wherein the coils have a front portion and a back portion, wherein a first angle between the front portion and the axis is less than 90 degrees, and wherein a second angle between the back portion and the axis is less than 90 degrees.

5. The hearing aid potentiometer of claim 1, wherein the floor is inclined at an angle of approximately 10 degrees.

* * * * *